US006716801B2

(12) United States Patent
Martin

(10) Patent No.: US 6,716,801 B2
(45) Date of Patent: Apr. 6, 2004

(54) COMPOSITIONS AND METHOD FOR THEIR PREPARATION

(75) Inventor: David William Martin, Liverpool (GB)

(73) Assignee: Pauline Abu-Jawdeh, London (GB)

( * ) Notice: Subject to any disclaimer, the term of this patent is extended or adjusted under 35 U.S.C. 154(b) by 0 days.

(21) Appl. No.: 10/327,771

(22) Filed: Dec. 23, 2002

(65) Prior Publication Data

US 2003/0134755 A1 Jul. 17, 2003

Related U.S. Application Data

(63) Continuation-in-part of application No. 09/947,021, filed on Sep. 5, 2001, now abandoned, which is a continuation of application No. PCT/GB00/00800, filed on Mar. 6, 2000, and a continuation-in-part of application No. 09/435,125, filed on Oct. 21, 1999, now abandoned, which is a continuation of application No. PCT/GB97/01223, filed on May 2, 1997.

(51) Int. Cl.[7] ..... C10M 173/00; C10M 141/02; C10L 1/32

(52) U.S. Cl. ..... 508/295; 508/291; 508/485; 508/562; 508/580; 508/583; 44/302

(58) Field of Search ..... 44/301, 300, 302; 508/545, 562, 579, 295, 291, 580, 583

(56) References Cited

U.S. PATENT DOCUMENTS

| | | | | | |
|---|---|---|---|---|---|
| 4,394,131 | A | * | 7/1983 | Marro et al. | 44/301 |
| 4,619,967 | A | * | 10/1986 | Emerson et al. | 524/801 |
| 4,744,796 | A | * | 5/1988 | Hazbun et al. | 44/302 |
| 4,832,868 | A | * | 5/1989 | Schmid et al. | 516/71 |
| 5,633,220 | A | * | 5/1997 | Cawiezel et al. | 507/117 |
| 5,643,555 | A | * | 7/1997 | Collin et al. | 424/59 |
| 5,902,227 | A | * | 5/1999 | Rivas | 516/54 |
| 5,976,200 | A | * | 11/1999 | Rivas et al. | 44/301 |
| 5,993,495 | A | * | 11/1999 | Sanchez et al. | 44/301 |
| 6,054,493 | A | * | 4/2000 | Bush | 516/27 |
| 6,379,682 | B1 | * | 4/2002 | Tchinnis et al. | 424/401 |

FOREIGN PATENT DOCUMENTS

| | | | |
|---|---|---|---|
| GB | 831046 | * | 3/1960 |
| GB | 1075196 | * | 7/1967 |
| WO | WO 98/50139 | * | 11/1998 |

* cited by examiner

*Primary Examiner*—Jacqueline V. Howard
(74) *Attorney, Agent, or Firm*—Fay, Sharpe, Fagan, Minnich & McKee, LLP

(57) ABSTRACT

A stable, clear water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from 0 to about 25 wt % of an emulsifier selected from polyisobutylsuccinimide, a sorbitan ester and mixtures thereof, and iii) from 0 to about 90 wt % of an amine ethoxylate. The microemulsion is useful as a fuel and/or lubricant/coolant.

29 Claims, No Drawings

COMPOSITIONS AND METHOD FOR THEIR PREPARATION

This application is a continuation-in-part, of U.S. patent application Ser. No. 09/947,021 filed Sep. 5, 2001 now abandoned, which is a continuation of PCT Application No. PCT/GB00/00800, filed Mar. 6, 2000, and a continuation-in-part of U.S. patent application Ser. No. 09/435,125 originally filed Oct. 21, 1999 now abandoned, which is a continuation of PCT Application No. PCT/GB97/01223, filed May 2, 1997.

FIELD OF THE INVENTION

The present invention concerns compositions and a method for their preparation. More particularly, the present invention concerns water-in-oil emulsions, suitable for use as a fuel or lubricant. In particular, the present invention concerns water-in-oil emulsions having improved stability and lubricity properties, wherein the average droplet size of the water phase in the oil phase is no greater than 0.1 $\mu$m.

BACKGROUND OF THE INVENTION

The use of water as an additive in fuel oils to reduce emissions of pollutants and to aid incorporation of other beneficial performance additives has been known for many years. The use of water as an additive in lubricant oils to improve the cooling properties of e.g. cutting oils has also been known for many years. Water is incorporated into the fuel and lubricant oils in the form of a water-in-oil emulsion Water-in-oil emulsions formed with a large water droplet size give a milky appearance. These emulsions require a number of secondary additives such as corrosion inhibitors and bactericides to overcome problems associated with addition of the water phase. These emulsions due to their large water droplet size also exhibit instability that leads to oil/water separation. Naturally, this is unwelcome as it may lead to problems with not only machine failure but also problems with loss of production in say a diesel-powered generator.

Water-in-oil emulsions formed with an average water droplet size of less than 0.1 $\mu$m are translucent. This small droplet size not only gives an appearance which is more aesthetically pleasing to the user but also offers several major advantages over the larger droplet-sized systems. The clear emulsions tend to be more stable than the milky emulsions, as the water droplets remain in dispersion longer and do not readily undergo macro oil/water phase separation. The small droplet size also appears to negate the need for both corrosion inhibitors and bactericides.

U.S. Pat. No. 3,346,494 (Robbins et al) discloses the preparation of microemulsions employing a selected combination of three microemulsifiers, specifically a fatty acid, an amino alcohol and an alkyl phenol.

FR-A-2373328 (Grangette et al) discloses the preparation of microemulsions of oil and salt water, employing sulphur containing surfactants.

U.S. Pat. No. 3,876,391 (McCoy et al) discloses a process for preparing clear, stable water-in-petroleum microemulsions, which may contain increased quantities of water-soluble additives. The microemulsions are formed by use of both a gasoline-soluble surfactant and a water-soluble surfactant. The only water-soluble surfactants employed in the worked examples are ethoxylated nonylphenols.

U.S. Pat. No. 4,619,967 (Emerson et al) discloses the use of water-in-oil emulsions for emulsion polymerisation processes.

U.S. Pat. No. 4,770,670 (Hazbun et al) discloses stable water-in-fuel microemulsions employing a cosurfactant combination of a phenyl alcohol and an ionic or nonionic surfactant.

U.S. Pat. No. 4,832,868 (Schmid et al) discloses surfactant mixtures useful in the preparation of oil-in-water emulsions. There is no disclosure of any water-in-oil microemulsion comprising at least 60 wt % oil phase.

U.S. Pat. No. 5,633,220 (Cawiezel) discloses the preparation of a water-in-oil emulsion fracturing fluid including an emulsifying agent sold by ICI under the trademark Hypermer (Hpermer emulsifying agents are not disclosed as being $C_6$–$C_{15}$ alcohol ethoxylates or mixtures thereof).

Mixtures of $C_6$–$C_{15}$ alcohol ethoxylates are commercially available surfactants normally sold for use in the preparation of e.g. washing detergents.

WO-A-9818884 (Ying et al), which was published on May 7, 1998, discloses water-in-fuel microemulsions, including examples of such emulsions comprising a $C_8$ alcohol ethoxylate, with 6 EO groups, mixed with a polyglyceryl-4-monooleate, and mixtures of $C_9$–$C_{11}$ alcohol ethoxylates mixed with either polyglyceryl oleates linear alcohols or POE sorbitan alcohols. The presence of the polyglyceryl oleates and POE sorbitan alcohols tend to have detrimental effects on the viscosity properties of the emulsions which, in turn, has a consequential detrimental effect on the lubricity properties of the emulsion.

The water-in-oil emulsions previously sold for use as fuels and lubricants generally contain surfactants that, due to incomplete combustion emit by-products, are potentially harmful to the environment, such as nitrogen-, phenyl- and sulphur-containing compounds, and/or have detrimental effects on the lubricity properties. There is a continuing need therefore to provide new fuels and lubricants that do not suffer the same problems. With this background, however, any new fuel and lubricant must also perform at least as well as the prior art fuels and lubricants.

Cutting oils, based on water-in-oil emulsions, have been used to lubricate machine tools. The excellent coolant property of the water has been demonstrated to improve the life of the tool. However, the incorporation of water coupled with the instability of macroemulsions give rise to other problems, such as the lubricity of the oil is decreased with addition of water thereby affecting the surface finish of the metal.

It is the object of the present invention to provide novel water-in-oil microemulsions that may be used as fuels or lubricants and which, without loss of performance, employ surfactants that may be more environmentally acceptable than those hitherto employed in fuels. It is a further object of the present invention to provide a novel water-in-oil microemulsion that may require less surfactant than is used in conventional water-in-oil microemulsion fuels and lubricants.

As there is a tendency in the design of modern engines to employ the fuel not only as a fuel per se, but also as a lubricant and coolant, where a portion of fuel is continually recirculated between the hot engine and fuel tank, it is a further object of the present invention to provide a water-in-oil microemulsion fuel or lubricant that may demonstrate improved stability It is a further object of the present invention to provide a water-in-oil microemulsion fuel or lubricant that may demonstrate improved lubricity.

SUMMARY OF THE INVENTION

In a first aspect, the present invention provides a stable, clear water-in-oil emulsion, useful as a fuel or lubricant, consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from 0 to about 25 wt % of said emulsifier composition of an emulsifier selected from polyisobutylsuccinimde, a sorbitan ester and mixtures thereof, iii) from 0 to about 90 wt % of an amine ethoxylate.

In another embodiment of the first aspect, the present invention provides a stable, clear water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils and lubricating oils, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from about 0.3 to about 25 wt % of said emulsifier composition of an emulsifier selected from polyisobutylsuccinimde, a sorbitan ester and mixtures thereof, iii) from 0 to about 40 wt % of an amine ethoxylate, and iv) from 0 to about 25 wt % of a compound selected from ethylene glycol and butoxyethanol.

In yet another embodiment of the first aspect, the present invention provides a stable, clear water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from about 15 to about 90 wt % of an amine ethoxylate and iii) from 0 to about 80 wt % tall oil fatty acid amine.

In a second aspect, the present invention is a method of improving the stability of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consisting essentially of i) a mixture of $C_6$–$C_{15}$ alcohol ethoxylates, each comprising from 2 to 12 EO groups, ii) from 0 to about 25 wt % of said emulsifier composition of an emulsifier selected from polyisobutylsuccinimde, a sorbitan ester and mixtures thereof, iii) from 0 to about 90 wt % of an amine ethoxylate, wherein said method comprises mixing said oil, said emulsifier composition and said water to form a clear, stable microemulsion.

In another embodiment of the second aspect, the present invention is a method of improving the stability of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 0.3 to about 25 wt % of said emulsifier composition of an emulsifier selected from polyisobutylsuccinimde, a sorbitan ester and mixtures thereof, iii) from 0 to about 40 wt % of an amine ethoxylate, and iv) from 0 to about 25 wt % of a compound selected from ethylene glycol and butoxyethanol, wherein said method comprises mixing said oil, said emulsifier composition and said water to form a clear, stable microemulsion.

In yet another embodiment of the second aspect, the present invention is a method of improving the stability of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 15 to about 90 wt % of an amine ethoxylate and iii) from 0 to about 80 wt % tall oil fatty acid amine, wherein said method comprises mixing said oil, said emulsifier composition and said water to form a clear, stable microemulsion.

In a third aspect, the present invention is a method of improving the lubricity of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consisting essentially of i) a mixture of $C_6$–$C_{15}$ alcohol ethoxylates, each comprising from 2 to 12 EO groups, ii) from 0 to about 25 wt % of said emulsifier composition of an emulsifier selected from polyisobutylsuccinimde, a sorbitan ester and mixtures thereof, iii) from 0 to about 90 wt % of an amine ethoxylate, wherein said method comprises mixing said oil, said emulsifier composition and said water to form a clear, stable microemulsion.

In another embodiment of the third aspect, the present invention is a method of improving the lubricity of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 μm, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 0.3 to about 25 wt % of said emulsifier composition of an emulsifier selected from polyisobutylsuccinimde, a sorbitan ester and mixtures thereof, iii) from 0 to about 40 wt % of an amine ethoxylate, and iv) from 0 to about 25 wt % of a compound selected from ethylene glycol and butoxyethanol, wherein said method comprises mixing said oil, said emulsifier composition and said water to form a clear, stable microemulsion.

In yet another embodiment of the third aspect, the present invention is a method of improving the lubricity of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 15 to about 90 wt % of an amine ethoxylate and iii) from 0 to about 80 wt % tall oil fatty acid amine, wherein said method comprises mixing said oil, said emulsifier composition and said water to form a clear, stable microemulsion.

Where the oil is a fuel oil, the water-in-fuel emulsions of the present invention have cleaner emissions, with no nitrogen-, phenyl- or sulphur-by-products, and demonstrate at least similar if not improved performance over the prior art fuels i.e. reduced particulate matter and improved combustion rates (leading to better fuel consumption). Surprisingly, the emulsifier composition used in the present is highly efficient and may be employed in lesser amounts than surfactants employed in the prior art fuels.

The use of heavier oils as, for example, machine cutting fluids can also benefit from this technology as there may be an increase in lubricity. The present emulsions may have high stability, improved lubricity and improved combustion properties without the problems of corrosion or bacterial growth.

DETAILED DESCRIPTION

The present invention provides new water-in-oil emulsions and methods for their preparation. The droplets of the water phase of the emulsion have an average droplet size of no greater than 0.1 $\mu$m. These emulsions are clear translucent emulsions. Thus in a further aspect the present invention provides a composition for preparing a water-in-oil emulsion, wherein the emulsion is a clear translucent emulsion. Any reference in the present specification to "a water-in-oil emulsion, wherein the average droplet size of the water phase of the water-in-oil emulsion is no greater than 0.1 $\mu$m", is analogous to the term "a water-in-oil emulsion wherein the emulsion is a clear translucent emulsion".

Oil is a hydrocarbon feedstock and can consist of any of the following: diesel; kerosene; gasoline (leaded or unleaded); paraffinic, naphthenic or synthetic oils; and synthetic oils such as esters, poly alpha olefins; etc, and mixtures thereof.

The term "solution" herein describes any mixtures, which are clear and homogenous. The term "behaves as such" means that the mixture has substantially the same stability as a solution.

An important area of use for the new emulsions is in the heavy duty diesel engine market, particularly trucks, buses and other heavy duty transport vehicles, where the engines of these vehicles are designed to use the emulsions as lubricants and coolants, rather than just as a fuel, although the present invention is not limited to this application area.

In one aspect the present invention provides a composition for preparing an emulsion combining the cooling properties of the added water with the lubricity of the fuel continuous phase in such a manner that a stable clear translucent fluid is obtained. Whilst giving these benefits the emulsions of this invention exhibit none of the disadvantages associated with conventional fluids i.e. bacterial growth, corrosion, reduced stability etc.

The present invention provides a composition for preparing a stable emulsion. By referring to the emulsion of the present invention as being "stable", we mean that the water phase in the water-in-oil emulsion exists as dispersed droplets having an average particles size of no greater than 0.1 $\mu$m in the oil phase for at least 12 months when stored at a constant temperature of 25° C. The emulsion is of a continuous fuel phase in which water droplets, having an average droplet size of no greater than or <0.1 $\mu$m are dispersed. The resultant clear translucent emulsion remains thermodynamically stable when used as a lubricant or coolant in a modern heavy duty diesel engine and further offers both high lubricity and improved combustion properties.

The present invention provides a sufficiently high water content fluid that, due to the extremely small droplet size, cannot support microbial growth.

Other than in the operating examples, or where otherwise indicated, all numbers expressing quantities of ingredients used herein are to be understood as modified in all instances by the term "about".

The emulsion of the present invention may be prepared from fuels that are standard grades available at any service station. Preferably, the fuel oil is selected from diesel, kerosene, gasoline (leaded or unleaded) and mixtures thereof.

The mixture ratios of the fuel and water phases of the present emulsion can be varied depending on the application of the emulsion. Generally speaking, the fuel phase comprises at least about 60%, more preferably at least about 70%, most preferably about 80% by weight, based on the total of the fluid phases, fuel and water. Generally speaking, the fuel phase comprises no greater than about 95% by weight, and preferably no more than about 90% by weight. (Each percentage by weight is based on the total of the fluid phases, i.e. the combined weight of both fuel and water phases).

Typically, the emulsion comprises from about 5 to about 30% by weight of emulsifier composition, preferably from about 5 to about 20%, and even more preferably from about 5 to about 10%. The emulsifier composition is most preferably chosen to minimise the amount of emulsifier composition to form a microemulsion for a given fluid.

As well as the mixture of $C_6$–$C_{15}$ alcohol ethoxylates, the emulsifier composition may include one or more of fatty (e.g. $C_{14}$–$C_{22}$) acid amines, fatty (e.g. $C_{14}$–$C_{22}$) acid amides, ethoxylated fatty (e.g. $C_{14}$–$C_{22}$) acid amines, sorbitan esters, ethoxylated fatty (e.g. $C_{14}$–$C_{22}$) acid amides and fatty (e.g. $C_{14}$–$C_{22}$) acid esters. Preferably, the emulsions of the present invention include an ethoxylated amine, more preferably a ($C_6$ to $C_{24}$)alkyl ethoxylated amine such as an ethoxylated fatty (e.g. $C_{14}$–$C_{22}$) acid amine.

Where a compound is referred to as being "ethoxylated", we mean it includes at least 2 EO groups. Preferably ethoxylated compounds comprise from 2 to 12 EO groups. For example, suitable alcohol ethoxylated compounds include those with 2 to 5 EO groups, more suitably compounds with 2 to 3 EO groups The mixture of $C_6$–$C_{15}$ alcohol ethoxylates employed in the emulsifier composition is preferably a mixture of $C_9$–$C_{14}$ alcohol ethoxylates, such as a mixture of $C_9$ to $C_{11}$ alcohol ethoxylates or a mixture of $C_{12}$–$C_{14}$ alcohol ethoxylates. The distribution of any of the components in the mixture can range from 0 to 50% by weight, and are preferably distributed in a Gaussian format. Commercially available $C_6$–$C_{15}$ alcohol ethoxylates include relevant products sold under the trademarks Wickenol (available from Witco, England), Neodol (available from Surfachem, England), Dobanol (available from Shell, England), and Synperonic (available from ICI, England), although some of the products may not be exclusively from these ranges.

The emulsifier composition optionally comprises an emulsifier selected from polyisobutylsuccinimde, a sorbitan ester and mixtures thereof. A sorbitan ester is the reaction product of sorbitol and a fatty acid, preferably a $C_{16}$–$C_{22}$ fatty acid, such as stearic acid, oleic acid and lauric acid. Oleic acid is the most preferred acid. The sorbitol and acid may be reacted in the ratio 1:1, 1:2, or 1:3, respectively.

In a further preferred embodiment of the present invention, the emulsion comprises and emulsifier composition which consisting of the following: (i) 240 parts $C_{12}$–$C_{14}$ alcohol ethoxylate such as Laoropal 2 (available from Witco, England); (ii) 20 parts sorbitan ester such as Sorbax SMO (available from Alpha Chemical, England); and (iii) 1 part polyisobutylsuccinimide such as Kerrocom (available from BASF, Germany).

In a further preferred aspect the present invention may provide a composition which comprises the following: (i) 200 parts $C_9$–$C_{11}$ alcohol ethoxylate; (ii) 50 parts ethylene glycol; and (iii) 1 part polyisobutylsuccinimide.

In a further preferred aspect the present invention may provide a composition which comprises the following: (i) 2 parts $C_6$–$C_{15}$ alcohol ethoxylate; (ii) 1 part butoxyethanol; and (iii) 1 part sorbitan ester.

In a further preferred aspect the present invention may provide an emulsion comprising (i) 10 parts water; (ii) 90 parts diesel fuel; and (iii) a emulsifier composition as defined herein, in amount of 14 parts by volume relative to the total fuel and water.

In a further preferred aspect the present invention may provide an emulsion comprising (i) 10 parts water; (ii) 90 parts unleaded petrol; and (iii) a emulsifier composition as defined herein, in amount of 10 parts by volume relative to the total fuel and water.

In a further preferred aspect the present invention may provide an emulsion comprising (i) 10 parts water; (ii) 90 parts diesel fuel; and (iii) a emulsifier composition as defined herein, in amount of 12 parts by volume relative to the total fuel and water.

The water phase used can be taken directly from the local water supply.

The emulsion may comprise additional components dissolved or suspended in either the water phase or oil phase. These additional components may be incorporated to improve anti-wear or extreme pressure properties. The requirement to add additional components may be dictated by the application area in which the invention is used. Suitable additional components, and the requirements thereof depending on application area, will be apparent to those skilled in the art.

Preferably, oils other than fuels may be selected from an ester type oil, a mineral oil, a synthetic type oil, and mixtures thereof.

The mixture ratios of the oil and water phases of the present emulsion can be varied depending on the application of the emulsion. Generally speaking, the oil phase comprises at least about 60% by weight, based on the total of the fluid phases, oil and water. Preferably the oil phase comprises between about 60% and about 85% by weight. Generally speaking, the oil phase comprises no greater than about 95% by weight or more preferably about 90% by weight. (Each percentage by weight is based on the total of the fluid phases oil and water).

In a further embodiment of the present invention an emulsifier composition comprises the following: (i) 4 parts $C_6$–$C_{15}$ alcohol ethoxylate; (ii) 1 part amine ethoxylate; and (iii) 1 part polyisobutylsuccinimide.

In a further embodiment of the present invention an emulsifier composition comprises the following: (i) 3 parts amine ethoxylate; (ii) 1 part fatty acid amine; and (iii) 1 part polyisobutylsuccinimide.

In a further embodiment of the present invention an emulsifier composition comprises the following: (i) 2 parts $C_6$–$C_{15}$ alcohol ethoxylate; (ii) 2 part fatty acid amine ethoxylate; and (iii) 1 part sorbitan ester.

In a further aspect the present invention may provide an emulsion comprising (i) 20 parts water; (ii) 80 parts an ester type oil; and (iii) an emulsifier composition as defined herein, in amount of 17 parts by volume relative to the total oil and water.

In a further aspect the present invention may provide an emulsion comprising (i) 30 parts water; (ii) 70 parts a mineral oil; and (iii) an emulsifier composition as defined herein, in amount of 23 parts by volume relative to the total oil and water.

In a further aspect the present invention may provide an emulsion comprising (i) 20 parts water; (ii) 80 parts a synthetic type oil; and (iii) an emulsifier composition as defined herein, in amount of 16 parts by volume relative to the total oil and water.

The water phase used can be taken directly from the local water supply.

The present invention may be utilised in, among others, the industrial lubricants applications and is suited to all uses within that application area.

The emulsion may comprise additional components dissolved or dispersed within either the water phase or the oil phase. These additional components may be incorporated to improve anti-wear or extreme pressure properties. The requirement to add additional components may be dictated by the application area in which the invention is used. Suitable additional components, and the requirement thereof depending on application area, will be apparent to those skilled in the art.

Some embodiments of the invention in its various aspects are now described in detail in the following examples. All ratios, parts and percentages are expressed by weight unless otherwise specified, and all reagents used are of good commercial quality unless otherwise specified.

EXAMPLES

As described above, reference to "a water-in-oil emulsion wherein the emulsion is a clear translucent emulsion" is analogous to the term "a water-in-oil emulsion, wherein the average droplet size of the water phase of the water-in-oil emulsion is no greater than 0.1 μm". In the present examples emulsions were visually inspected. Those, which were clear and translucent, were considered to have an average droplet size of the water phase of the water-in-oil emulsion of no greater than 0.1 μm.

Example 1

An emulsifier composition suitable for combining fuel with water was prepared by adding the following components in the quantities stated:

240 parts $C_6$–$C_{15}$ alcohol ethoxylate 10 parts sorbitan ester 1 part polyisobutylsuccinimide The components were gently mixed to form a homogenous solution.

Example 2

An emulsifier composition suitable for combining fuel with water was prepared by adding the following components in the quantities stated:

200 parts $C_6$–$C_{15}$ alcohol ethoxylate 50 parts ethylene glycol 1 part polyisobutylsuccinimide The components were gently mixed to form a homogenous solution.

Example 3

An emulsifier composition suitable for combining fuel with water was prepared by adding the following components in the quantities stated:

2 parts $C_6$–$C_{15}$ alcohol ethoxylate 1 part butoxyethanol 1 part sorbitan ester The components were gently mixed to form a homogenous solution.

Example 4

The emulsifier composition from Example 1 was used to combine 90 parts of a diesel fuel with 10 parts water. Sufficient composition was introduced to and gently mixed with the fuel and water from a burette until a clear translucent fluid was observed. The resulting fluid remains stable when held at 25° C. for more than one year.

Example 5

The composition from Example 2 was used to combine 90 parts of unleaded petrol with 10 parts water. Sufficient composition was introduced to and gently mixed with the fuel and water from a burette until a clear translucent fluid was observed. The resulting fluid remains stable when held at 25° C. for more than one year.

Example 6

The composition from Example 3 was used to combine 90 parts of diesel fuel with 10 parts water. Sufficient composition was introduced to and gently mixed with the fuel and water from a burette until a clear translucent fluid was observed. The resulting fluid remains stable when held at 25° C. for more than one year.

Example 7

The fluids from examples 4,5 and 6 have all been subjected to industry standard tests for anti-wear properties, microbial growth, corrosion and anti-foaming properties. All of the fluids demonstrated comparable anti-wear properties to the base fluid from which they were prepared. No microbial growth, corrosion or excessive foaming was observed in any of the fluids.

Example 8

The fluids from examples 4,5 and 6 were subjected to evaluation of their heat capacity in relation to the base fuel from which they were prepared. In all cases the heat capacity was significantly higher in the microemulsions than the straight fuel.

Example 9

The fluids from examples 4,5 and 6 were subjected to carbon residue tests as outlined in British Standard EN590. All were within the specifications laid out in the standard document.

Example 10

The fluids from examples 4,5 and 6 were subjected to lubricity evaluation using both the High Frequency Reciprocating Rig (HFRR—ASTM D6079) and the Ball on Cylinder Test (BOCLE—ASTM D6078). The fluids all demonstrated better lubricity using the BOCLE test than diesel alone whilst giving wear values <400 μm for the HFRR test (these latter values being well within specification).

Example 11

The diesel-water emulsion of Example 3 was used to run a diesel engine in a simple test drive. No adverse changes were noted in the performance of the vehicle.

Example 12

An emulsifier composition suitable for combining oil with water was prepared by adding the following components in the quantities stated:

4 parts $C_6$–$C_{15}$ alcohol ethoxylate 1 part amine ethoxylate 1 part polyisobutylsuccinimide The components were gently mixed to form an homogenous solution.

Example 13

An emulsifier composition suitable for combining oil with water was prepared by adding the following components in the quantities stated:

3 parts $C_9$–$C_{11}$ alcohol ethoxylate 1 part fatty acid amine 1 part polyisobutylsuccinimide The components were gently mixed to form an homogenous solution.

Example 14

An emulsifier composition suitable for combining oil with water was prepared by adding the following components in the quantities stated:

2 parts $C_6$–$C_{15}$ alcohol ethoxylate 2 part fatty acid amine ethoxylate 1 part sorbitan ester The components were gently mixed to form an homogenous solution.

Example 15

The composition from Example 12 was used to combine 80 parts of an ester base oil with 20 parts water. Sufficient composition was introduced to and gently mixed with the oil and water from a burette until a clear translucent fluid was observed. The resulting fluid remains stable when held at 25° C. for more than one year.

Example 16

The composition from Example 13 was used to combine 70 parts of a mineral base oil with 30 parts water. Sufficient composition was introduced to and gently mixed with the oil and water from a burette until a clear translucent fluid was observed. The resulting fluid remains stable when held at 25° C. for more than one year.

Example 17

The composition from Example 14 was used to combine 80 parts of a synthetic base oil with 20 parts water. Sufficient composition was introduced to and gently mixed with the oil and water from a burette until a clear translucent fluid was observed. The resulting fluid remains stable when held at 25° C. for more than one year.

Example 18

The fluids from examples 15,16 and 17 have all been subjected to industry standard tests for anti-wear properties, microbial growth, corrosion and anti-foaming properties. All of the fluids demonstrated comparable anti-wear properties to the base fluid from which they were prepared. No microbial growth, corrosion or excessive foaming was observed in any of the fluids.

Example 19

The fluids from examples 15,16 and 17 were subjected to evaluation of their heat capacity in relation to the base oil from which they were prepared. In all cases the heat capacity was significantly higher in the microemulsions than the straight base fluids.

This indicates a higher capacity for the fluid to cool the metal when being worked.

Example 20

The fluids from examples 15,16 and 17 were subjected to corrosion tests using aluminium test material. This test is particularly relevant for fluids that are intended for use in the rolling oils market. The aluminium was immersed in the fluid and subjected to varying pressures and temperatures (up to 500 psi and 250° C. for 7 days). In all cases no corrosion was observed on the test materials.

Example 21

A comparable test to that in example 20 was undertaken using a commercial soluble oil, which is a dispersion of finely divided oil droplets in a continuous water phase, and an invert macroemulsion, which is a milky fluid comprising a dispersion of large water droplets in a continuous oil phase. In both cases corrosion was observed on the aluminium test pieces.

Example 22

To demonstrate the ease with which the microemulsion fluids can be disposed a sample of waste material from a machine trial was used as a fuel material in a heating system. The fluid was used with no clean up and found to give no problems to the heating system. Naturally this would not be possible using soluble or water mix fluids due to their high water content.

Example 23

Microemulsion fluids have been formed using all conventional base fluid types used in the lubricant industry. These being:

Mineral Oils
Naphthenic Oils
Paraffin Oils
Ester Oils
Glycol's
Synthetic Oils
Linear Alpha Hydrocarbons Example 24

A $C_9$–$C_{11}$ alcohol ethoxylate (Neodol) alone and a mixture of $C_9$–$C_{11}$ alcohol ethoxylate (Neodol) and POE Sorbitan alcohol in a ratio of 80/20 by weight were each used to combine 90 parts of a diesel fuel with 10 parts water. Sufficient composition was introduced to and gently mixed with the fuel and water from a burette until a clear translucent fluid was observed. The resulting fluid based on Neodol alone remained stable when held at 25° C. for more than one year, whereas the Neodol/PEO sorbitan alcohol 80/20 mix underwent visible phase separation after 9 months.

The two fluids may also be subjected to lubricity evaluation using the Ball on Cylinder Test (BOCLE). The fluid based on Neodol alone will demonstrate more than 5% better lubricity (BOCLE) than the Neodol/PEO sorbitan alcohol 80/20 mix.

All publications mentioned in the above specification are herein incorporated by reference. Various modifications and variations of the described methods and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the claims.

What is claimed is:

1. A stable, clear water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from 0 to about 25 wt % of an emulsifier selected from the group consisting of: polyisobutylsuccinimide, a sorbitan ester and mixtures thereof, and iii) from 0 to about 90 wt % of an amine ethoxylate.

2. An emulsion as claimed in claim 1, wherein said emulsion comprises from about 5 to about 10% by weight of said emulsifier composition.

3. An emulsion as claimed in claim 1, wherein said oil is selected from the group consisting of diesel, kerosene, gasoline and mixtures thereof.

4. An emulsion as claimed in claim 1, wherein said oil is selected from the group consisting of mineral oil, paraffinic base oil, naphthenic base oil, synthetic oil, cutting oil, hydraulic fluid, gear oil and grinding fluid.

5. An emulsion as claimed in claim 4, wherein said oil is selected from the group consisting of paraffinic base oil and naphthenic base oil.

6. An emulsion as claimed in claim 1, wherein said emulsifier composition consists essentially of i) a mixture of $C_6$–$C_{15}$ alcohol ethoxylates, each comprising from 2 to 12 EO groups, ii) from about 0.3 wt % to about 20 wt % of said emulsifier, and iii) from 0 to about 90 wt % of an amine ethoxylate.

7. An emulsion as claimed in claim 6, wherein said emulsifier composition consists essentially of i) a mixture of $C_6$–$C_{15}$ alcohol ethoxylates, each comprising from 2 to 12 EO groups, ii) about 20 wt % of said emulsifier, and iii) from about 20 to about 40 wt % of an amine ethoxylate.

8. An emulsion as claimed in claim 6, wherein said emulsifier composition consists essentially of i) a mixture of $C_6$–$C_{15}$ alcohol ethoxylates, each comprising from 2 to 12 EO groups, and ii) about 0.4 wt % of an emulsifier selected from the group consisting of polyisobutylsuccinimde, and a sorbitan ester.

9. An emulsion as claimed in claim 1, wherein said emulsifier composition consists essentially of i) a mixture of $C_6$–$C_{15}$ alcohol ethoxylates, each comprising from 2 to 12 EO groups, ii) from 0 to about 25 wt % of an emulsifier selected from the group consisting of polyisobutylsuccinimide, a sorbitan ester and mixtures thereof, iii) from 0 to about 90 wt % of a fatty acid amine ethoxylate.

10. An emulsion as claimed in claim 1, wherein said emulsifier composition consists essentially of a mixture of $C_6$–$C_{15}$ alcohol ethoxylates, each comprising from 2 to 12 EO groups, and from about 20 to about 90 wt % of amine ethoxylate.

11. An emulsion as claimed in claim 1, wherein said emulsifier composition consists essentially of a mixture of $C_6$–$C_{15}$ alcohol ethoxylates, each comprising from 2 to 12 EO groups, and from about 20 to about 90 wt % of fatty acid amine ethoxylate.

12. A stable, clear water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils and lubricating oils, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from about 0.3 to about 25 wt % of emulsifier selected from polyisobutylsuccinimide, a sorbitan ester and mixtures thereof, iii) from 0 to about 40 wt % of an amine ethoxylate, and iv) from 0 to about 25 wt % of a compound selected from ethylene glycol and butoxyethanol.

13. An emulsion as claimed in claim 12, wherein said emulsion comprises from about 5 to about 10% by weight of said emulsifier composition.

14. An emulsion as claimed in claim 12, wherein said oil is selected from the group consisting of diesel, kerosene, gasoline and mixtures thereof.

15. An emulsion as claimed in claim 12, wherein said oil is selected from the group consisting of mineral oil, paraffinic base oil, naphthenic base oil, synthetic oil, cutting oil, hydraulic fluid, gear oil and grinding fluid.

16. An emulsion as claimed in claim 15, wherein said oil is selected from the group consisting of paraffinic base oil and naphthenic base oil.

17. A stable, clear water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from about 15 to about 90 wt % of an amine ethoxylate and iii) from 0 to about 80 wt % tall oil fatty acid amine.

18. An emulsion as claimed in claim 17, wherein said emulsion comprises from about 5 to about 10% by weight of said emulsifier composition.

19. An emulsion as claimed in claim 17, wherein said oil is selected from the group consisting of diesel, kerosene, gasoline and mixtures thereof.

20. An emulsion as claimed in claim 17, wherein said oil is selected from the group consisting of mineral oil, paraffinic base oil, naphthenic base oil, synthetic oil, cutting oil, hydraulic fluid, gear oil and grinding fluid.

21. An emulsion as claimed in claim 20, wherein said oil is selected from the group consisting of paraffinic base oil and naphthenic base oil.

22. A method of improving the stability of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consisting essentially of i) a mixture of $C_6$–$C_{15}$ alcohol ethoxylates, each comprising from 2 to 12 EO groups, ii) from 0 to about 25 wt % of an emulsifier selected from polyisobutylsuccinimide, a sorbitan ester and mixtures thereof, and iii) from 0 to about 90 wt % of an amine ethoxylate, wherein said method comprises mixing said oil, said emulsifier composition and said water to form a clear, stable microemulsion.

23. A method of improving the stability of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 0.3 to about 25 wt % of an emulsifier selected from polyisobutylsuccinimide, a sorbitan ester and mixtures thereof, iii) from 0 to about 40 wt % of an amine ethoxylate, and iv) from 0 to about 25 wt % of a compound selected from ethylene glycol and butoxyethanol, wherein said method comprises mixing said oil, said emulsifier composition and said water to form a clear, stable microemulsion.

24. A method of improving the stability of a water-in-oil emulsion consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 15 to about 90 wt % of an amine ethoxylate and iii) from 0 to about 80 wt % tall oil fatty acid amine, wherein said method comprises mixing said oil, said emulsifier composition and said water to form a clear, stable microemulsion.

25. A method of preparing a water-in-oil emulsion having improved lubricity properties and consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consisting essentially of i) a mixture of $C_6$–$C_{15}$ alcohol ethoxylates, each comprising from 2 to 12 EO groups, ii) from 0 to about 25 wt % of an emulsifier selected from polyisobutylsuccinimide, a sorbitan ester and mixtures thereof, iii) from 0 to about 90 wt % of an amine ethoxylate, wherein said method comprises mixing said oil, said emulsifier composition and said water to form a clear, stable microemulsion.

26. A method of preparing a water-in-oil emulsion having improved lubricity properties and consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 0.3 to about 25 wt % of an emulsifier selected from polyisobutylsuccinimide, a sorbitan ester and mixtures thereof, iii) from 0 to about 40 wt % of an amine ethoxylate, and iv) from 0 to about 25 wt % of a compound selected from ethylene glycol and butoxyethanol, wherein said method comprises mixing said oil, said emulsifier composition and said water to form a clear, stable microemulsion.

27. A method of preparing a water-in-oil emulsion having improved lubricity properties and consisting of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, said emulsifier composition consists essentially of i) a mixture of $C_6$–$C_{15}$ alcohol ethoxylates, each comprising from 2 to 12 EO groups, ii) from about 15 to about 90 wt % of an amine ethoxylate and iii) from 0 to about 80 wt % tall oil fatty acid amine, wherein said method comprises mixing said oil, said emulsifier composition and said water to form a clear, stable microemulsion.

28. A stable, clear water-in-oil emulsion comprising from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from 0 to about 25 wt % of an emulsifier selected from the group consisting of: polyisobutylsuccinimide, a sorbitan ester and mixtures thereof, and iii) from 0 to about 90 wt % of an amine ethoxylate.

29. A stable, clear water-in-oil emulsion according to claim 28, consisting essentially of from about 5 to about 40 wt % aqueous phase and from about 95 to about 60 wt % non-aqueous phase, said aqueous phase being dispersed in said non-aqueous phase in the form of droplets having an average droplet size no greater than about 0.1 $\mu$m, said emulsion comprising at least 60 wt % of an oil selected from fuel oils, lubricating oils and mixtures thereof, from about 5 to about 30 wt % of an emulsifier composition, and the balance to 100 wt % water, wherein said emulsifier composition consists essentially of i) a mixture of $C_6$–$C_{15}$ alcohol ethoxylates, each comprising from 2 to 12 EO groups, ii) from 0 to about 25 wt % of an emulsifier selected from the group consisting of: polyisobutylsuccinimide, a sorbitan ester and mixtures thereof, and iii) from 0 to about 90 wt % of an amine ethoxylate.

* * * * *